United States Patent [19]

Bulso, Jr. et al.

[11] 4,020,670

[45] May 3, 1977

[54] TRIPLE ACTION MECHANISM FOR PRODUCING HIGH REDUCTION CUPS IN A DOUBLE ACTION PRESS

[75] Inventors: Joseph D. Bulso, Jr., Canton, Ohio; Robert T. Hipple, deceased, late of Dayton, Ohio, by Glendora Hipple, executrix

[73] Assignee: Redicon Corporation, Canton, Ohio

[22] Filed: Mar. 19, 1976

[21] Appl. No.: 668,506

[52] U.S. Cl. ..... 72/349; 113/120 H

[51] Int. Cl.[2] ..... B21D 22/28

[58] Field of Search ..... 72/349, 348; 113/120 H

[56] References Cited

UNITED STATES PATENTS

| | | | |
|---|---|---|---|
| 2,318,819 | 5/1943 | Verson | 72/349 |
| 3,855,862 | 12/1974 | Mollen | 72/349 |

*Primary Examiner*—Leon Gilden

*Attorney, Agent, or Firm*—Witherspoon, Lane & Hargest

[57] ABSTRACT

This invention relates to apparatus adaptable for use on a double acting press for producing high reduction metallic cups of high quality. The double acting press is provided with a crankshaft having a pair of offset cranks for attachment to the outer punch holder and the redraw horn assembly to produce a time lag between the operation of the outer punch holder and the redraw horn assembly. The high reduction cupping apparatus comprises a housing having an opening extending vertically therethrough, a redraw horn assembly centrally mounted in the housing for reciprocation therein, a pair of vertically disposed redraw cushion cylinders positioned within and in the upper portion of the housing, said redraw cushion cylinder surrounding the upper portion of the redraw horn assembly, a cushion piston movably carried in each cushion cylinder, said redraw cushion pistons being in engagement with each other for cumulative pressure effects, a cylindrical drawn horn and pressure sleeve fitting around the redraw horn assembly and having its upper portion engageable by the lower redraw cushion piston, a pair of vertically displaced pressure ring cylinders positioned within the housing and around the redraw horn assembly immediately below the redraw cushion cylinder pair, each pressure ring cylinder carrying a pressure ring piston fitting around the draw horn, said pressure ring pistons being in engagement with each other for cumulative pressure effects, a pressure ring reciprocably carried in the lower end of the housing and fitting around the lower end of the draw horn, the lower pressure ring piston engaging and applying cumulative pressure to the pressure ring, an annular cutter fixedly mounted on the lower end of the housing and surrounding the lower end of the pressure ring, a stationary die holder positioned beneath the lower end of the housing, said die holder having a central vertically extending hole therethrough, concentrically located with the above parts, a blank and draw die mounted in the upper portion of the die holder concentrically with this aforementioned hole, said blank and draw die having an external diameter slightly less than that of the annular cutter so that a shearing action may take place therebetween, the inner diameter of the blank draw die being sized to receive the draw horn in the drawing operation, a redraw die mounted in the die holder concentrically with the hole in the die holder, said redraw die being sized to receive the redraw horn assembly in the redrawing operation.

8 Claims, 9 Drawing Figures

TRIPLE ACTION MECHANISM FOR PRODUCING HIGH REDUCTION CUPS IN A DOUBLE ACTION PRESS

SUMMARY OF THE INVENTION

This invention relates to high reduction drawing and more particularly to apparatus for use in conjunction with a double acting press to produce a high reduction metallic cup of high quality.

The tremendous demand for cans in the world today spurs all parties in the industry to spend considerable time and resources in continuing development programs in an effort to provide the public with less expensive and better quality cans. In keeping with such efforts the high reduction drawing apparatus of this invention was developed.

In view of the foregoing, it is an object of this invention to provide apparatus for use in conjunction with a double acting press to produce a high reduction metallic cup of high quality.

It is another object of this invention to provide apparatus for producing high reduction metallic cups more rapidly than before and thereby decrease the produce cost.

It is yet another object to provide apparatus for high reduction quality work which is reliable and easy to maintain.

It is still a further object of this invention to provide high reduction apparatus adapted for use in conventional double acting presses.

The above and other objects and advantages will become more apparent when taken in conjunction with the following detailed description and drawings.

IN THE DRAWINGS

FIG. 1 is a sectional view of the punch and die components with the metal strip introduced into the press and ready to be severed to form the disc from which the cup is drawn, FIG. 2 is a sectional view similar to FIG. 1 and illustrates the position of the punch and die components at the commencement of the drawing operation, FIG. 3 is a sectional view similar to FIG. 1 and shows the apparatus as it appears at the end of the first draw, FIG. 3*a* is a sectional view similar to FIG. 1, illustrating the apparatus with the draw horn holding the cup formed by the first draw against the top of the redraw die in preparation for the redraw, FIG. 4 is a sectional view similar to FIG. 1, illustrating the apparatus just after start of the redraw and wherein the housing and associated outer punch elements are ready to move upwardly from the punch press base, FIG. 5 is similar to FIG. 1 and shows the apparatus as it appears when the outer punch housing and associated elements are in position whereby further upward movement will release hold on the flange of the redraw cup by the draw horn, FIG. 6 is a view similar to FIG. 1 and shows the apparatus as it appears at the end of downward travel of the redraw horn and just prior to pneumatic removal of the redrawn cup from the redraw horn, FIG. 7 is a cycle chart illustrating positions of the apparatus throughout a complete 360° cycle, including relative positions of the outer punch assembly and the redraw horn assembly, and FIG. 8 is a view of the entire operating unit in overall form.

DETAILED DESCRIPTION OF THE INVENTION

Figure 8:
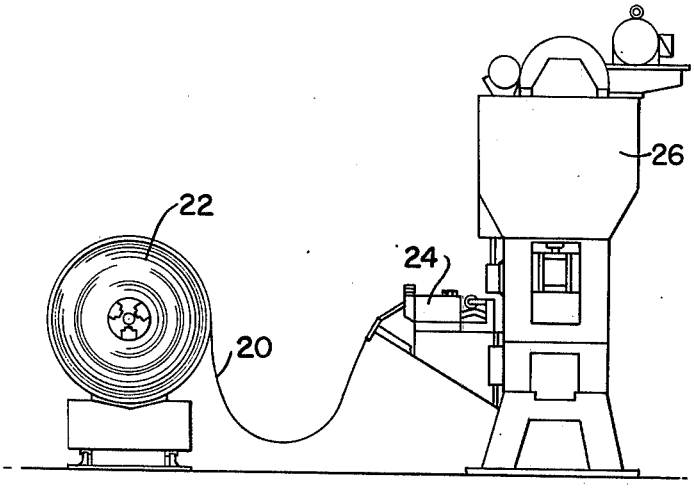

As illustrated in FIG. 8, metal strip 20 proceeds from coil 22 to feeder 24 and then into the press 26 in a step-wise manner according to the operation of the press 26. This press is a double acting unit having a crank shaft with a pair of offset cranks adapted to provide the proper time spacing between operation of the outer punch assembly 30 and the redraw horn assembly 32. Double acting presses with a crank shaft having a pair of offset cranks to provide desired time lag between operating components of the press are well known in the art and will not be further described herein.

Figure 1:
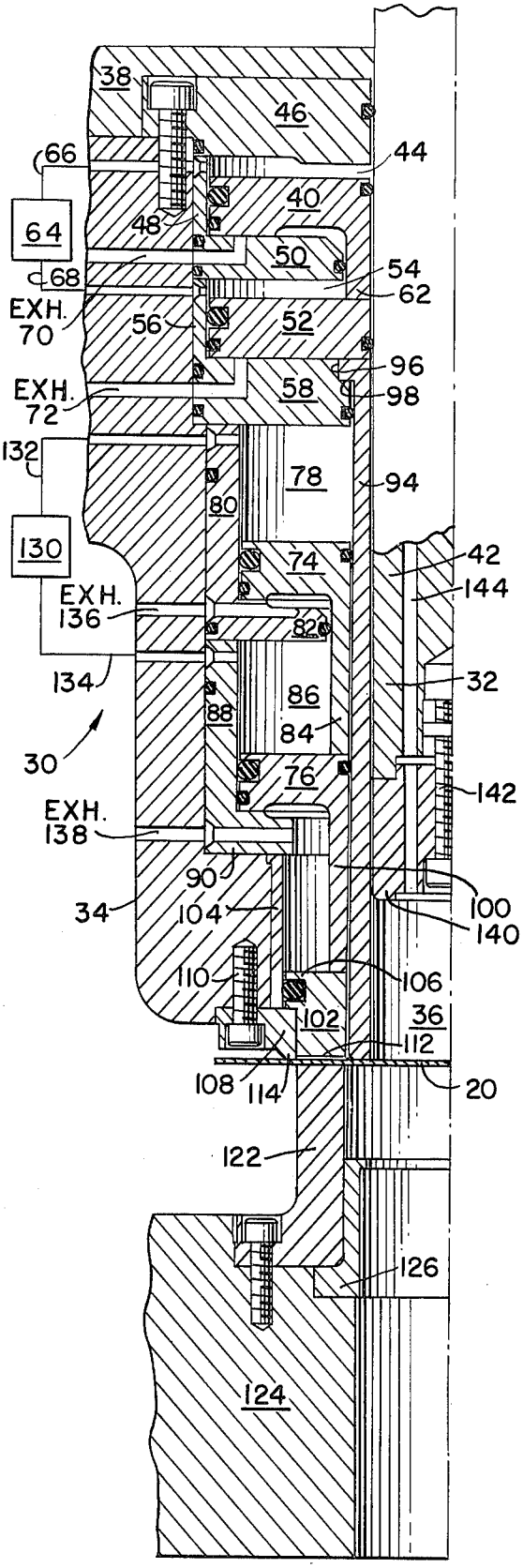

Referring to FIG. 1, the outer punch assembly 30 comprises an outer punch housing 34 having a central opening 36 extending vertically therethrough. The upper end of the outer punch housing is capped by the outer punch holder 38 affixed thereto. A redraw horn assembly 32 is positioned within the housing's vertical opening 36 for reciprocation therein. The upper end of the housing 34 contains a pair of redraw cushion piston-cylinder arrangements. Specifically upper cushion piston 40 surrounds the upper portion of the redraw horn riser 42 and vertically reciprocates in upper cushion cylinder chamber 44 formed by cylinder cap 46, side wall 48, bottom 50 and the outer wall of the redraw horn riser 42. Similarly, lower cushion piston 52 surrounds the upper portion of the redraw horn riser 42 immediately beneath the upper cushion piston 40 and vertically reciprocates in lower cushion cylinder chamber 54 formed by side wall 56, bottom 58 while the top is actually the lower face of the bottom 50 of the upper cylinder chamber 44. The inner wall for both the upper and lower cushion chambers 44 and 54 is formed by the redraw horn riser 42. Appropriate seals are provided as required to maintain the necessary air tight conditions. It should be noted that upper cushion piston 40 has a downwardly extending annular portion 62 whose bottom surface engages the upper face of the lower cushion piston 52.

Upper cushion chamber 44 and lower cushion chamber 54 are both connected to a constant pressure source 64 by way of conduits 66 and 68 to form a closed pressure system bearing down on the upper faces of both pistons, 40 and 52. The underside of each piston is exposed to a venting area by means of exhaust conduits 70 and 72.

Immediately beneath the two redraw cushion chambers there are provided upper and a lower pressure ring pistons 74 and 76 respectively. Specifically, upper pressure ring chamber 78 is formed by outer side wall 80, bottom 82, with the chamber top being the lower face of the lower cushion chamber bottom 58. Upper pressure ring piston 74 vertically reciprocates in chamber 78 in contact and in unison with lower pressure ring piston 76 by means of annular skirt portion 84 extending downwardly from the piston 74 into engagement with piston 76. Lower pressure ring chamber 86 is formed by outer side wall 88, bottom 90, with the lower face of bottom 82 forming the top of the chamber. The inner walls of chambers 78 and 86 are provided by cylindrical draw horn and pressure sleeve 94, said horn having an offset annular lip 96 adapted to seat on shoulder 98 of lower cushion chamber bottom 58 to limit downward travel thereof. As illustrated, the draw horn 94 fits around redraw horn assembly 32.

Lower pressure ring piston 76 has a downwardly extending annular skirt 100 whose lower end engages the upper face of base pressure ring 102 which is fitted between outer sleeve 104 and the draw horn 94 for vertical reciprocation. An annular shoulder 106 extends outwardly from the top portion of the base pressure ring 102 and abuts against a portion of annular cutter 108 which is secured to the lower portion of the housing 34 by means of screws 110. The lower sheet engaging face 112 of the base pressure ring 102 extends slightly below the cutting edge 114 of the cutter 108 when base pressure ring shoulder 106 abuts against the upper portion of the cutter 108 so that said face 112 will engage and hold the sheet 20 in position against blank and draw die 122 situated immediately therebeneath. Upper and lower pressure ring chambers 78 and 86 are connected to a constant pressure source 130 by way of conduits 132 and 134, thus forcing upper pressure ring piston 74 and lower pressure ring piston 76 downwardly so as to exert pressure on base pressure ring 102 thereby causing shoulder 106 of the base pressure ring 102 to abut against the annular cutter 108 and thus limit downward movement thereof. Chambers 78 and 86 are provided with exhausts 136 and 138 respectively.

Annular blank and draw die 122 is affixed to die holder 124 which is adapted for mounting on the base of the press. The redraw die 126 is mounted below and inwardly of the blank and draw die 122.

Redraw horn assembly 32 reciprocates within the outer punch housing assembly 30 and comprises a redraw horn riser 42 in the form of a circular rod extending downwardly within the draw horn and pressure ring 94 as well as upper and lower cushion chambers 44 and 54. A redraw horn 140 is secured to the lower end of the redraw horn riser 42 by means of screw 142. An air passage 144 is formed in the redraw horn 140 and redraw horn riser 42 to provide air pressure for ejecting the cup upon completion of the drawing and redrawing operations.

As is customary in multiple drawing operations, there is a time lag in operation of the draw and redraw assemblies so that the first draw may be completed and then the next draw commenced. The timing and actual motion of all of the active elements involved in such multiple drawing is quite critical. An example of the cycle operation for the draw and redraw assemblies is shown in FIG. 7 of the drawings and is correlated to the various Figures of the drawings showing the critical steps in the entire operating cycle.

Figure 7:
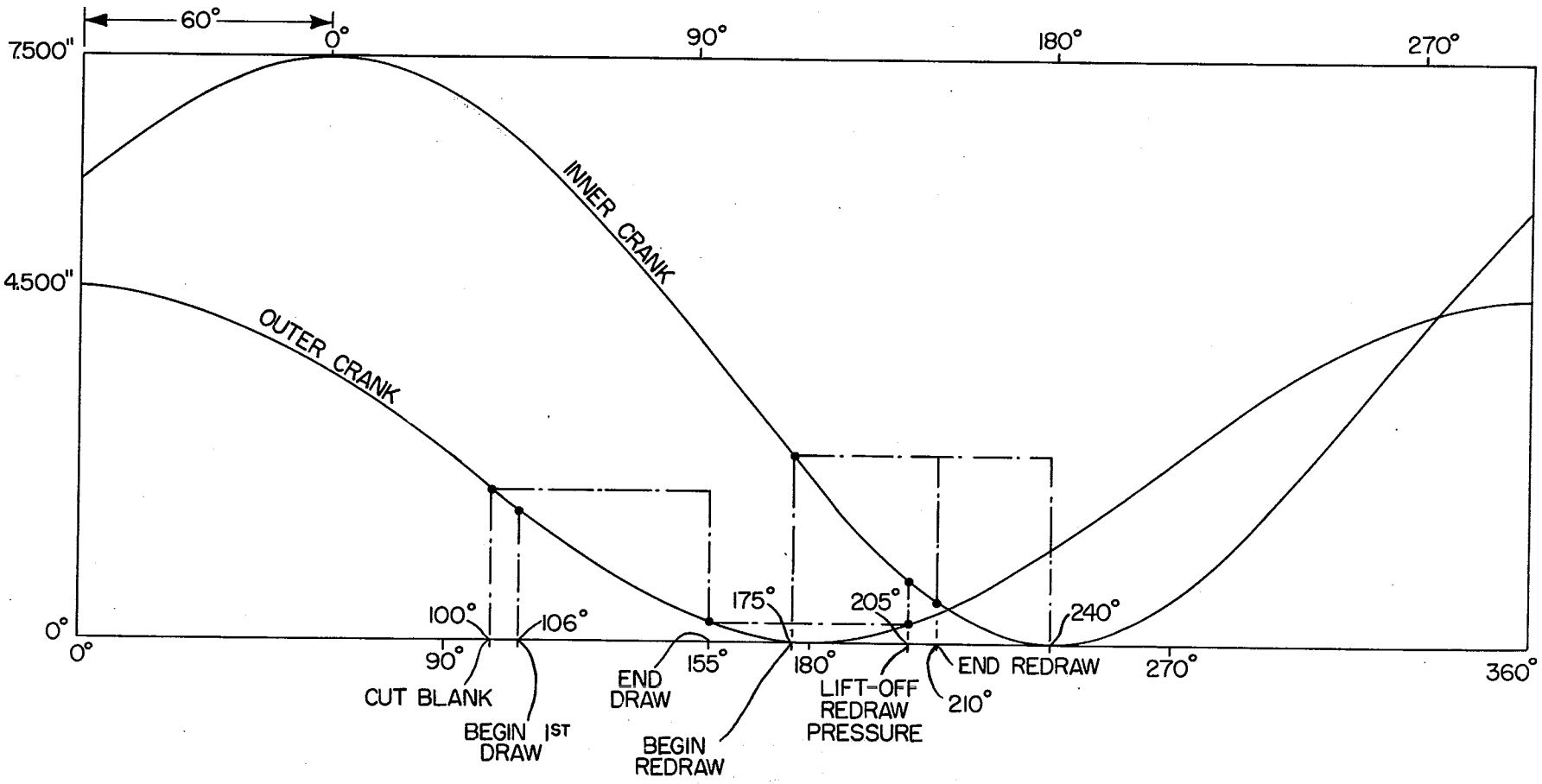

The basic operation in timed sequence is shown in FIG. 7 wherein the timed travel of the inner and outer crank is depicted for a complete 360° cycle. It will be immediately noticed that there is a 60° lag between the outer and inner crank, the outer crank being foremost. More specifically, the outer crank is operatively connected to the outer punch holder 38 which in turn is affixed to the outer punch housing 30. The annular cutter 108 and draw horn and pressure sleeve 94 are actuated by the outer crank through a combination of elements as will be described later. The inner crank lags behind the outer crank by 60° and is operatively connected to the redraw horn 140.

Referring to FIG. 1, the apparatus is shown in the initial stage with the strip 20 having been fed into the press and the outer crank moving to bring the housing 34 down so that the annular cutter 108 just touches the strip 20. Meanwhile, pressure in chambers 78 and 86 causes the pressure ring upper piston 74 and pressure ring lower piston 76 to move downwardly so that the annular depending portion 100 of piston 76 will engage the top of pressure ring 102 and cause it to move downwardly into engagement with the strip 20 and to force it against the upper end of blank and draw die 122 thereby holding the strip 20 in position for the blanking operation. While this is taking place, pressure in chambers 44 and 54 forces upper cushion piston 40 and lower cushion piston 52 downward whereby the top of draw horn and pressure sleeve 94 is engaged by piston 52 to cause the draw horn 94 to move downwardly and lightly engage the strip 20. The pressure being applied to strip 20 by the draw horn 94 is dependent upon the pressure in cushion chambers 44 and 54 and is never large enough to cause the draw horn 94 to deformingly act on the strip 20. Redraw horn 140 has begun its downward travel under the influence of the inner crank. The operative press elements and their positions as set forth above can be related to a position on the graph shown in FIG. 7 just prior to the 100° stage where the cutting of the blank takes place, for example 97°.

Figure 2:
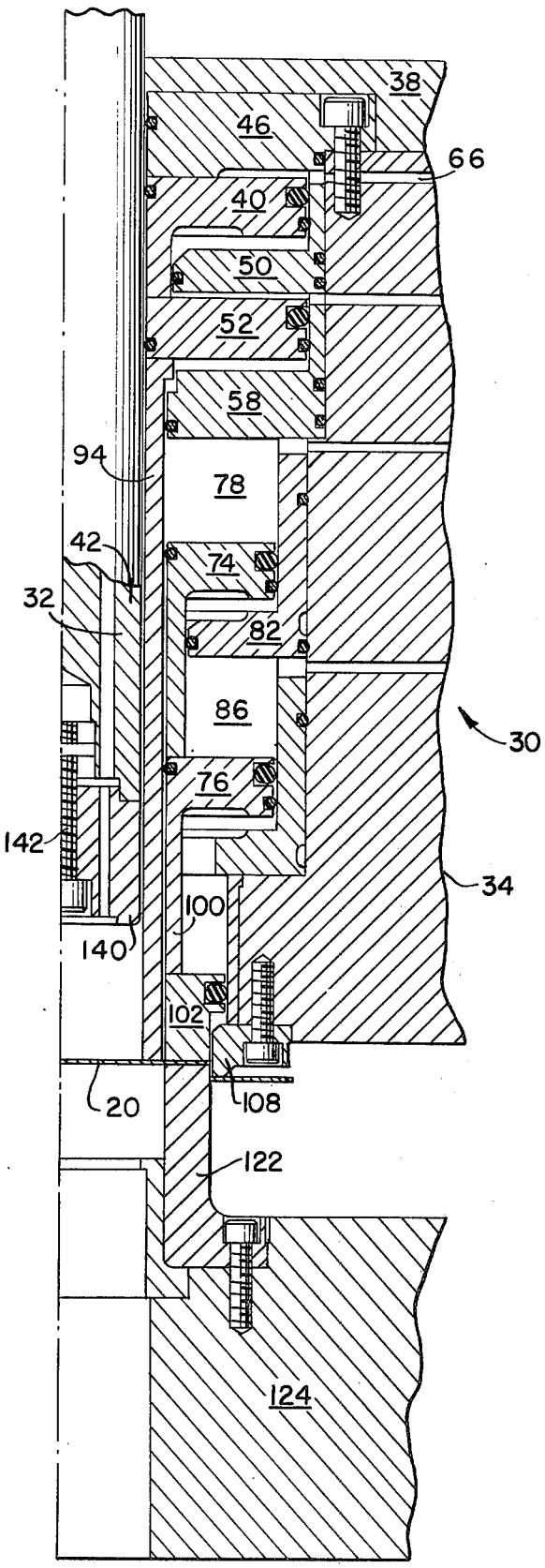

With continued press operation, the next significant step is illustrated in FIG. 2 wherein the housing has continued to descend so that the annular cutter 108 has cut the strip to form the desired blank and has continued its downward motion. It should be noted that draw horn 94 during this downward movement by the cutter 108 has remained stationary and in contact with strip 20. The provide this relative movement between these two elements, the draw horn 94 has forced the upper and lower cushion pistons 40 and 52 upwardly against the pressure in cushion chambers 44 and 54 so that the upper piston 40 ultimately abuts the lower face of cylinder cap 46. Simultaneously, the pressure ring 102 has remained in firm engagement with the blank and has forced upper and lower pressure ring pistons 74 and 76 to rise a distance approximately equal to that travelled by cushion pistons 40 and 52. With all of the press elements so positioned as shown in FIG. 2, the first draw commences since continued downward movement of the housing 34 will cause an equivalent movement of draw horn 94 because all of the travel of cushion pistons 40 and 52 has taken place. The start of the first draw occurs at approximately 106° of travel of the outer crank. The redraw horn 140 meanwhile has moved downwardly a slight distance as indicated.

Figure 3:
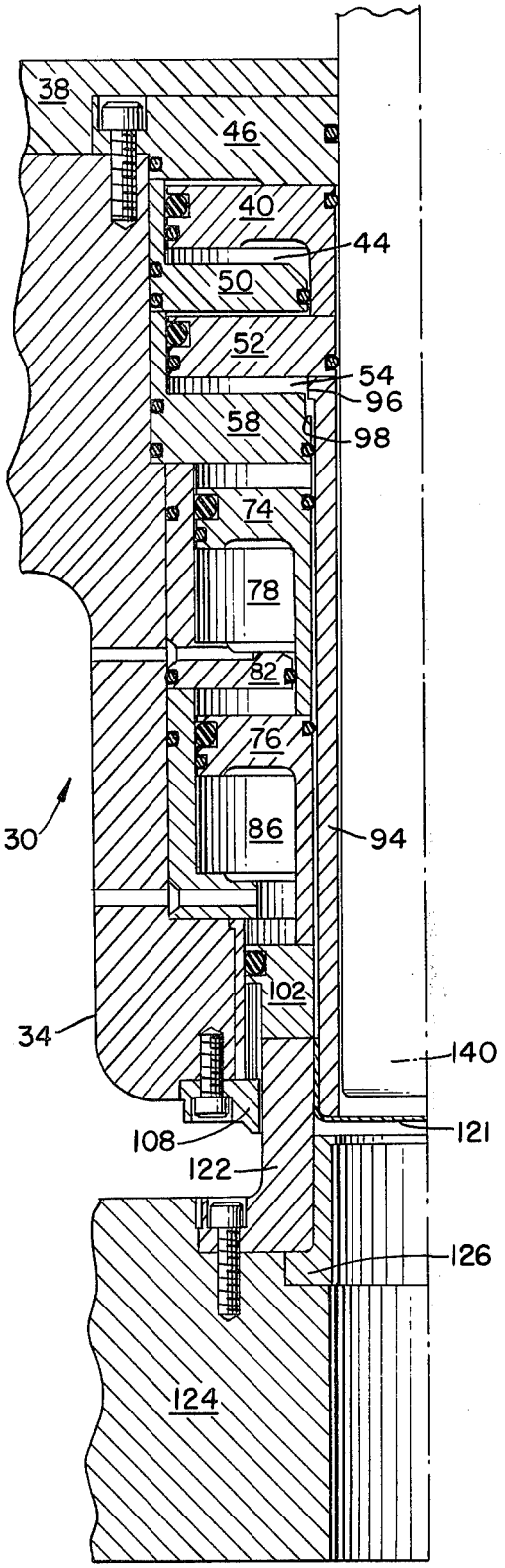

The position of all elements of the press upon completion of the first draw is illustrated in FIG. 3. It will be noted that draw horn 94 has travelled downwardly the distance required for the first draw and the blank has now taken the shape of a cup 121. The housing 34 has descended an amount equal to the first draw plus the overtravel of the cutter 108 and has carried with it all elements connected thereto. It should be noted that the top of the draw horn 94 is still in engagement with cushion piston 52 which in turn is in solid contact with cushion piston 40, said piston 40 still abuts cylinder cap 46. Thus movement of the draw horn 94 is identical to that of the housing 34 less the overtravel of cutter 108. The end of the first draw, as seen in FIG. 7, occurs at 155° of travel of the outer crank.

Figure 3A:
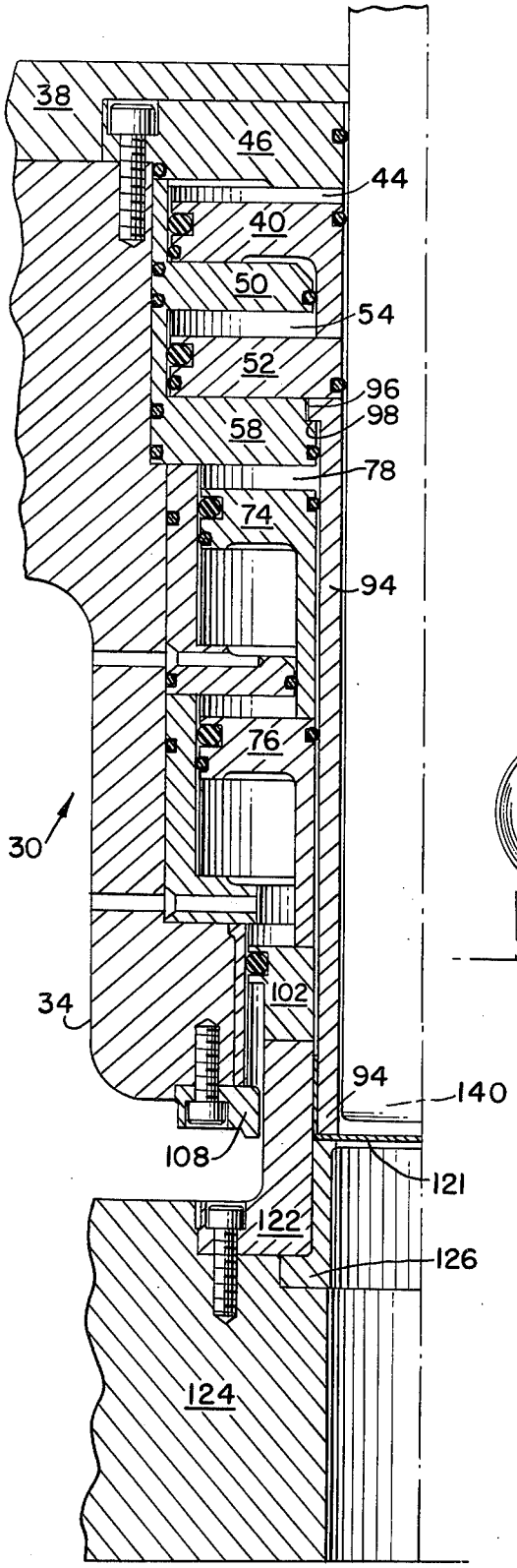

Referring to FIG. 7, at 155° of travel, the outer crank which is operatively attached to the housing 34 has not quite completed its downward travel. Due to the fact that pressure ring 102 no longer has any of the blank to grip, the draw horn 94 immediately descends under the chamber pressure bearing on cushion pistons 40 and 52 to move the cup 121 downward for gripping between the draw horn 94 and the top of redraw die 126. This is fully illustrated in FIG. 3*a* of the drawings wherein cushion pistons 40 and 52 have moved downwardly from their position shown in FIG. 3 to cause the draw horn 94 to force the drawn cup 121 downwardly into engagement with the top of redraw die 126. It should be observed that there is now a space between the top of cushion piston 40 and the bottom of cylinder cap 46.

The redraw operation begins at approximately 175° of travel of the outer crank, at this point the redraw horn commences engagement with the partially drawn cup 121. The travel of the inner crank which is operatively connected to the redraw horn 140 is also shown in FIG. 7. By using the degree scale across the top of the chart, it would thus appear that the redraw operation starts at approximately 115° of travel of the inner crank.

Figure 4:
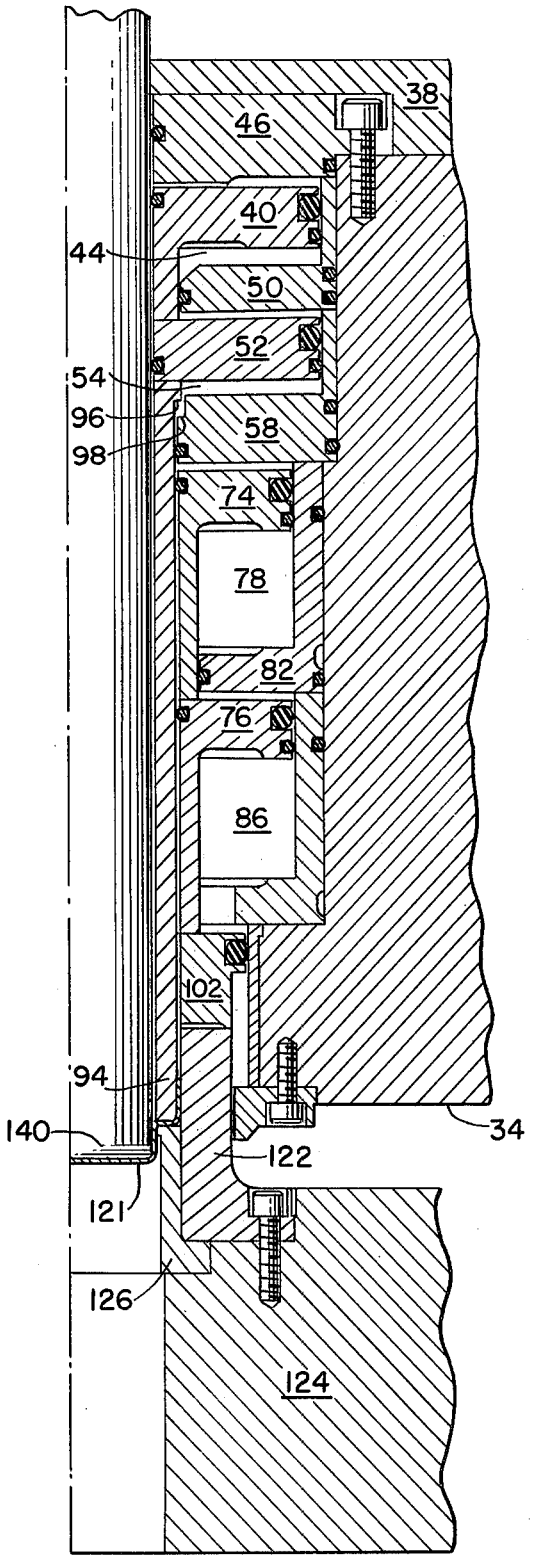

As both the inner and outer cranks turn, the outer crank bottoms out at 180° of travel which position is shown in FIG. 4. At this stage some of the redraw has been completed as indicated by the position of the redraw horn 140 with respect to the top of the redraw die 126. Also cushion chambers 44 and 54 have been significantly reduced in volume by the continued downward travel of the housing 34. Pressure in cushion chambers 44 and 54 acting upon pistons 40 and 52 which in turn act on draw horn 94 exert necessary redraw control on cup 121 against top redraw die 126.

Continued operation of the press causes the inner crank to move so as to further downwardly move the redraw horn 140, simultaneously the outer crank has started its return upward motion. As soon as the casing 34 starts to move upwardly, the pressure in cushion chambers 44 and 54 acts on cushion pistons 40 and 52 to retain the draw horn 94 in the position shown in FIG. 4 so as to continue to grip the partially drawn cup 121 between it and the top of the redraw die 126. This holding action continues until the shoulder 98 on cushion piston cylinder 58 engages the annular shoulder 96 on the upper end of the draw horn 94. As previously set forth, the cushion cylinder bottom 58 is affixed to and moves with the casing 34. At approximately 205° of travel of the outer crank, the press elements are in the position shown in FIG. 5 with the annular shoulder 96 on the draw horn 94 being engaged by the shoulder 98 on cylinder 58 so that further movement of the casing 34 will cause the draw horn 94 to be moved upwardly away from the redraw die 126.

Figure 6:
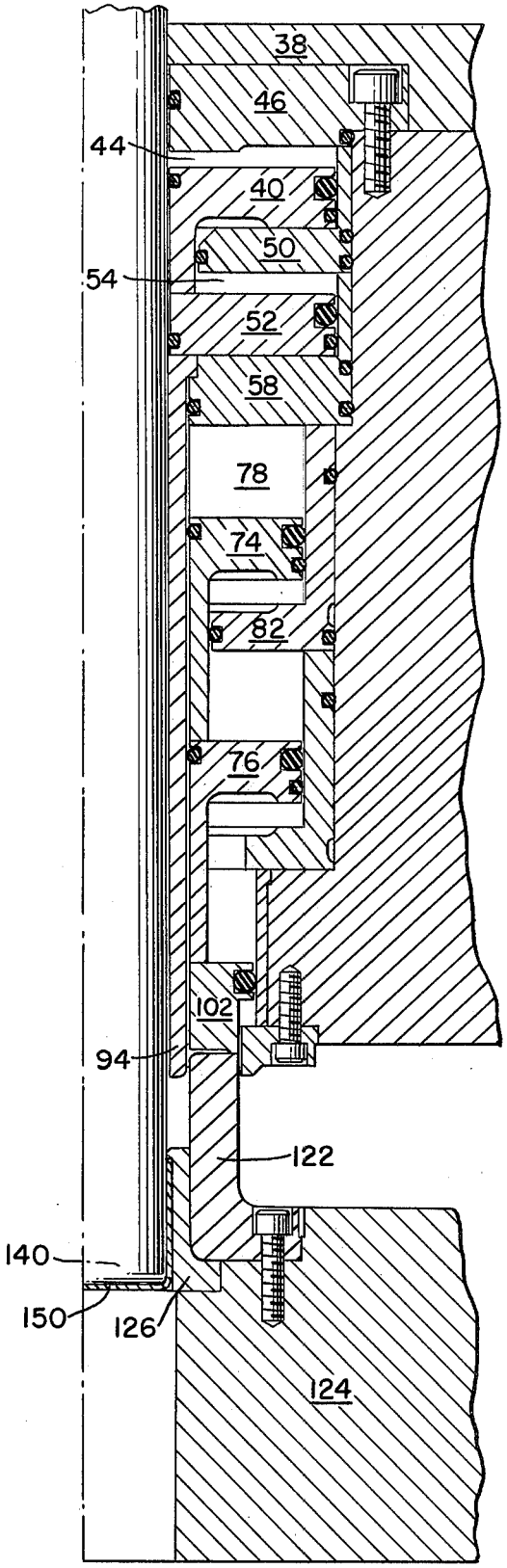

By the time the outer crank has travelled 210° the redraw operation has been completed. The operation of the press continues so that the redraw horn 140 reaches the bottom of its stroke, which occurs at 240° of travel of the outer crank (180° of the inner crank which drives the redraw horn) and the redrawn cup 150 is ready to be removed from the redraw horn 140. Removal is accomplished by means of air pressure fed down through the air passage 144 (See FIG. 1) which causes pressure to be exerted on the inner bottom of redrawn cup 150 to blow it off the redraw horn 140. The above is illustrated in FIG. 6 of the drawings wherein the redraw horn 140 has travelled the full downward stroke and the draw horn 94 is still moving upwardly toward its initial position. After the redrawn cup 150 has been removed from the redraw horn, the horn starts its upward travel so that when the outer crank has travelled 360° the draw horn 94 is fully drawn upwardly ready for the next cycle yet the inner crank still has 60° to traverse before the redraw horn 140 is fully drawn up to its top position.

The various controls required to produce the operation set forth above are conventional in the art and form no part of this invention and thus have not been illustrated or described.

The cooperation and relative movement of the operating elements of the press assembly of this invention may at first instance appear unimpressive. Yet, when the full impact of the significance of this assembly is understood, then the light begins to appear. It must be remembered that these presses are quite heavy and the rapid movement of cooperating elements produces enegy absorption problems which must be solved if the press is to operate at the necessary cycle time. In the press of this invention such problems have been solved by combining motions and steps so that direction changes and energy absorptions are handled in such a manner that the press will operate smoothly at very high speed, i.e., up to 120 cycles per minute.

More particularly, pressure ring 102 which holds the blank down in contact with the blank and draw die 122 is pressure operated through upper and lower pressure ring pistons 74 and 76 which are fluid pressure operated from common pressure source 130. Thus throughout the travel of pressure ring 102, it is pressure operated and cushioned even though the entire assembly is carried within the outer punch housing 34.

The function and operation of the draw horn and pressure sleeve 94 is quite unique. Referring to FIG. 1, the lower end of the draw horn 94 is in engagement with the upper surface of metal strip 120 under force created by pressure in upper and lower cushion chambers 44 and 54 which pressure is exerted on cushion pistons 40 and 52 to force the draw horn shoulder 96 into engagement with offset 98 in the bottom portion of cushion cylinder 58, thereby limiting the downward travel of the draw horn 94. Upon further downward movement of the housing 34 as the cutter 108 cuts the blank, (see FIG. 2), cushion pistons 40 and 52 are moved upwardly of the draw horn 94 until piston 40 bears against cylinder cap 46 after which the draw horn 94 moves in unison with the housing 34 to perform the initial drawing (see FIG. 3). Completion of the initial draw removes the blank from between pressure ring 102 and the upper face of draw die 122 so that the force created in cushion chambers 44 and 54 is sufficient to cause cushion pistons 40 and 52 to move downwardly and thereby move the draw horn 94 downwardly until the initially drawn cup 121 abuts the upper face of the redraw die 126 to hold same there during the first portion of the redraw (See FIG. 4).

Figure 5:
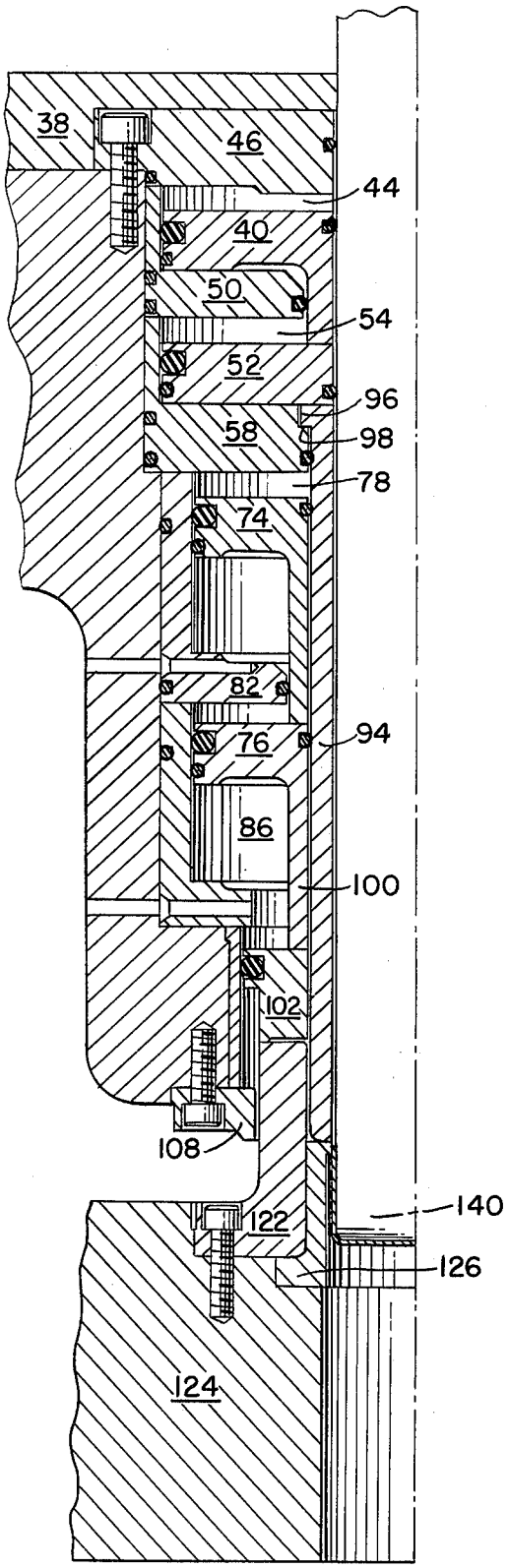

When the outer crank has traversed 180°, the housing 34 and associated parts have reached their lowest position. This is shown in FIG. 4. As the outer crank commences its upward trip carrying the housing 34 with it, draw horn 94 remains in contact with the partially redrawn cup 121 under pressure from cushion pistons 40 and 52 until draw horn shoulder 96 is engaged by offset 98 of the bottom of cylinder 58 to then cause the draw horn 94 to move upwardly with the upwardly moving housing 34. As shown in FIG. 5, upward movement of the draw horn 94 starts at approximately 205° of travel of outer crank while the redraw is completed at 210° of travel of the outer crank.

In view of the foregoing, it will be apparent that the draw horn and pressure sleeve 94 has a very unique function in the press assembly of this invention.

What is claimed is:

1. High reduction cupping apparatus comprising a housing having an opening extending vertically therethrough, a redraw horn assembly centrally mounted in the opening for reciprocation therein, fluid pressure cushion means within the upper portion of the housing, a cylindrical draw horn and pressure sleeve fitting around the redraw horn assembly and having its upper portion engageable by fluid pressure cushion means, annular pressure means positioned within the housing and around the redraw horn assembly immediately below the fluid pressure cushion means, a pressure ring reciprocably carried in the lower end of the housing and fitting around the lower end of the draw horn, the annular pressure means engaging and applying pressure to the pressure ring, an annular cutter fixedly mounted on the lower end of the housing and surrounding the lower end of the pressure ring, a stationary die holder positioned beneath the lower end of the housing, said die holder having a central vertically extending hole therethrough aligned with the opening in the housing, a blank and draw die mounted in the upper portion of the die holder concentrically with the aforementioned hole, said blank and draw die having an external diameter slightly less than that of the annular cutter so that a shearing action may take place therebetween, the inner diameter of the blank and draw die being sized to receive the draw horn in the drawing operation, the redraw horn assembly including a redraw horn mounted on the bottom of a redraw riser, a redraw die mounted in the die holder concentrically with the hole in the die holder, said redraw die being sized to receive the redraw horn in the redrawing operation, power means connected to the housing and redraw horn assembly to provide the timed movement of the housing and the redraw horn assembly in the combined drawing operation, and pneumatic pressure sources adapted for connection to the fluid pressure cushion means and the annular pressure means, said apparatus being adapted to receive a metal strip between the annular cutter and pressure ring on the upper side and the blank and draw die on the bottom side.

2. The invention as set forth in claim 1 and wherein the length of the draw horn and pressure sleeve is such that it will move vertically up and down relative to the housing in which it is carried to perform drawing and holding functions.

3. The invention as set forth in claim 1 and wherein the fluid pressure cushion means comprises a piston-cylinder means.

4. The invention as set forth in claim 3 and wherein the piston-cylinder means is annular and surrounds the upper portion of the redraw horn assembly and the cushion cylinder is fixed to the housing.

5. The invention as set forth in claim 3 and wherein the piston-cylinder means comprises a plurality of piston-cylinder units acting in conjunction with one another.

6. The invention as set forth in claim 4 and wherein the cushion piston is sized so that it will engage the draw horn and pressure sleeve and that both may move vertically up and down relative to the housing.

7. High reduction cupping apparatus comprising a housing having an opening extending vertically therethrough, a redraw horn assembly centrally mounted in the housing opening for reciprocation therein, a pair of vertically disposed cushion cylinders positioned within the upper portion of the housing, said cushion cylinders surrounding the upper portion of the redraw horn assembly, a cushion piston movably carried in each cushion cylinder, said cushion pistons being in engagement with each other for cumulative pressure effects, a cylindrical draw horn and pressure sleeve fitting around the redraw horn assembly and having its upper portion engageable by the lower cushion piston, a pair of vertically placed pressure ring cylinders positioned within the housing and around the redraw horn assembly immediately below the cushion cylinder pair, each pressure ring cylinder carrying a pressure ring piston fitting around the draw horn, said pressure ring pistons being in engagement with each other for cumulative pressure effects, a pressure ring reciprocably carried in the lower end of the housing and fitting around the lower end of the draw horn, the lower pressure ring piston engaging and applying cumulative pressure to the pressure ring, an annular cutter fixedly mounted on the lower end of the housing and surrounding the lower end of the pressure ring, a stationary die holder positioned beneath the lower end of the housing, said die holder having a central vertically extending hole therethrough aligned with the opening in the housing, a blank and draw die mounted in the upper portion of the die holder concentrically with the aforementioned hole, said blank and draw die having an external diameter slightly less than that of the annular cutter so that a shearing action may take place therebetween, the inner diameter of the blank draw die being sized to receive the draw horn in the drawing operation, the redraw horn assembly including a redraw horn mounted on the bottom of a redraw riser, a redraw die mounted in the die holder concentrically with the hole in the die holder, said redraw die being sized to receive the redraw horn in the redrawing operation, power means connected to the housing and redraw horn assembly to provide the timed movement of the housing and the redraw horn assembly in the combined drawing operation, and pneumatic pressure sources adapted for connection to the cushion cylinders and the pressure ring cylinders so that pressure may be applied to the upper surfaces of all the pistons, said apparatus being adapted to receive a metal strip between the annular cutter and pressure ring on the upper side and the blank and draw die on the bottom side.

8. The invention as set forth in claim 1 and wherein the cooperating members of the high reduction cupping apparatus are so sized that upon the completion of the drawing step the partially drawn blank continues to be engaged by the draw horn and is forced downwardly into engagement with the redraw die under action of the fluid pressure cushion means acting on the draw horn, said fluid pressure cushion means retaining the draw horn in such position until the redraw step is almost completed.

* * * * *